US009653007B2

(12) United States Patent
Boyer et al.

(10) Patent No.: US 9,653,007 B2
(45) Date of Patent: May 16, 2017

(54) CHANNEL LETTER AND TRIM CAP RETAINING CLIP THEREFOR

(71) Applicants: Clyde H. Boyer, Concord, OH (US); Robert Schilling, Olmsted Falls, OH (US)

(72) Inventors: Clyde H. Boyer, Concord, OH (US); Robert Schilling, Olmsted Falls, OH (US)

( * ) Notice: Subject to any disclaimer, the term of this patent is extended or adjusted under 35 U.S.C. 154(b) by 0 days.

(21) Appl. No.: 15/137,775

(22) Filed: Apr. 25, 2016

(65) Prior Publication Data

US 2016/0314725 A1 Oct. 27, 2016

Related U.S. Application Data

(60) Provisional application No. 62/152,129, filed on Apr. 24, 2015, provisional application No. 62/269,319, filed on Dec. 18, 2015.

(51) Int. Cl.
*G09F 13/04* (2006.01)
*G09F 7/00* (2006.01)

(52) U.S. Cl.
CPC ..... *G09F 13/0404* (2013.01); *G09F 7/002* (2013.01)

(58) Field of Classification Search
CPC ..... G09F 13/0404; G09F 7/16
See application file for complete search history.

(56) References Cited

U.S. PATENT DOCUMENTS

| | | | |
|---|---|---|---|
| 1,697,501 | A | 1/1929 | Gast |
| 1,721,918 | A | 7/1929 | Meyercord |
| 2,141,955 | A | 12/1938 | Lang |
| 3,254,436 | A | 6/1966 | Bank |
| 3,579,886 | A | 5/1971 | Hughes |
| 3,760,552 | A | 9/1973 | Skoetsch |
| 3,988,846 | A | 11/1976 | Kuhling |
| 4,024,658 | A | 5/1977 | Hoerner |
| 4,097,632 | A | 6/1978 | Minogue et al. |
| 4,796,170 | A | 1/1989 | Pedersen et al. |
| 6,318,585 | B1 | 11/2001 | Asagiri et al. |
| 6,481,132 | B1 | 11/2002 | Grate et al. |
| 6,748,686 | B2 | 6/2004 | Grate et al. |
| 7,096,638 | B2 | 8/2006 | Osterland et al. |
| 7,181,875 | B2 | 2/2007 | Lewis |
| 7,427,088 | B1 | 9/2008 | Annerino et al. |
| 8,424,230 | B2 | 4/2013 | Boyer |
| 8,434,251 | B2 | 5/2013 | Lee et al. |
| 8,484,871 | B2 | 7/2013 | Boyer |

(Continued)

FOREIGN PATENT DOCUMENTS

| | | |
|---|---|---|
| KR | 1020110041077 | 4/2011 |
| WO | WO 2006/006823 | 1/2006 |

*Primary Examiner* — Gary Hoge
(74) *Attorney, Agent, or Firm* — Fay Sharpe LLP; James E. Scarbrough

(57) ABSTRACT

A channel letter has a rear surface for mounting against a raceway, wall, or a structure for supporting the signage, and sheet metal sides defining the figuration of the letter or shape to be depicted. A lighting element is positioned against the rear surface of the enclosure, and a lens is retained to the open front of the enclosure. The lens is secured with a retainer cap and a plurality of retainer clips. Each of the retainer clips comprises as least one side including an outwardly extending leg for retention with the retainer cap.

17 Claims, 5 Drawing Sheets

(56) References Cited

U.S. PATENT DOCUMENTS

| | | | | |
|---|---|---|---|---|
| 8,701,319 | B2 | 4/2014 | Boyer | |
| 8,756,841 | B2 | 6/2014 | Boyer | |
| 9,261,121 | B2 | 2/2016 | Boyer | |
| 2001/0042330 | A1* | 11/2001 | Grate | G09F 13/0404 40/552 |
| 2002/0104241 | A1* | 8/2002 | Grate | G09F 13/0404 40/552 |
| 2003/0182833 | A1* | 10/2003 | Lewis | C09J 7/0296 40/551 |
| 2012/0192470 | A1* | 8/2012 | Boyer | G09F 13/04 40/607.15 |
| 2013/0255119 | A1* | 10/2013 | Boyer | G09F 7/16 40/596 |
| 2013/0255123 | A1* | 10/2013 | Boyer | G09F 7/16 40/607.14 |
| 2014/0268741 | A1* | 9/2014 | Quaal | G09F 13/0404 362/235 |

* cited by examiner

CHANNEL LETTER AND TRIM CAP RETAINING CLIP THEREFOR

This application claims priority to U.S. Provisional Patent Application No. 62/152,129, filed Apr. 24, 2015, by Boyer et al. and entitled "CHANNEL LETTER AND TRIM CAP RETAINING CLIP THEREFOR" and U.S. Provisional Patent Application No. 62/269,319, filed Dec. 18, 2015, by Boyer and entitled "CHANNEL LETTER SIGN ASSEMBLY"; and are incorporated herein by reference in their entirety.

BACKGROUND

The present invention relates to channel letters of the type used to create signage and, in particular, to an improved retainer clip for retaining the trim cap and lens to the enclosure of a channel letter.

Channel letters are used to provide signage for buildings, shopping malls, and the like where it is desirable that the signage comprise illuminated letters or any other shapes that are easily seen, even at great distances, day or night. Each channel letter consists of an enclosure, usually a metal box, having a rear surface which is positioned against a raceway, or the wall of a building, on which the signage is mounted and a plurality of sides which define the figuration of a letter or number (or other shape) which make up a portion of the sign. A light source, such as a neon tube, LEDs, or other lighting mechanisms, can be positioned within the walls of the enclosure and attached to the rear (and/or side) surface to provide illumination for the letter or shape.

The light sources used in many existing channel letters are neon bulbs requiring high voltage power with transformers built into the metal enclosures. To prevent injury to those servicing such channels letters many municipalities require that such letters be inspected to ensure that they are adequately sealed using standards set by Underwriters Laboratories.

It is expected that relatively new technology in lighting sources will soon become the most prevalent for the manufacturers of channel letters. Specifically, low voltage LED type light sources have been developed which provide a very long lasting bright light without requiring the high voltage and transformers needed for neon lighting. It is expected that channel letters employing the new technology will not be required to meet the same standards set by Underwriters Laboratories for neon tubes.

In addition to the lighting, a channel letter also includes a planar transparent lens, the outer shape of which corresponds to the figuration of the letter or any other shape defined by the sides of the enclosure. The manufacture of the lens requires that the planar panel of transparent plastic be cut to the shape of the enclosure. The lens of existing channel letters have a trim cap glued or welded to the outer edges thereof which form a border to the lens. The trim cap also has a lip which, when assembled to the enclosure, is shaped to fit snugly around the forward ends of the walls thereof for retaining the lens to the enclosure and to maintain the water tight seal required by Underwriters Laboratories. Heretofore, typically screws are threaded through the lips of the trim cap and into the enclosure walls to retain the lens across the forward opening of the enclosure.

It would be desirable to provide a channel letter assembly having a lens and trim cap which could be installed without incurring the labor intensive, and aesthetically displeasing, step of attaching the trim cap with screws. It would also be desirable to provide a less cumbersome method of disassembling the trim cap and lens to gain access to the interior of the enclosure of a channel letter and the subsequent reassembling.

BRIEF DESCRIPTION

Briefly, the present invention is embodied in a channel letter. For the purposes of this description, a channel letter is defined as an illuminated contoured fixture in the shape of a letter of the alphabet, a numeral, an element of punctuation such as a comma, an exclamation point, or any other shape or form intended to constitute a portion of a sign advertisement or display.

The channel letter of the present invention has a rear surface for mounting against a raceway, a wall, or any other structure suitable for supporting the signage. The walls defining the figuration of the letter or shape to be depicted are made of sheet metal, or plastic, having a given thickness. A lighting element, such as a strip of LEDs according to the newly available technology or any other light source, is positioned against, or proximal to, the rear surface of the enclosure to provide illumination therefore.

A channel sign assembly can include a channel letter comprising an enclosure having at least two opposing walls. The at least two opposing walls can define the shape of the letter and include an open front. The at least two opposing walls can have an inner surface and a forward end. A lens can have a forward surface and an outer edge in the shape of the letter. A plurality of selectively positioned and oriented retention clips adjacent the forward end can frictionally and/or adhesively engage the enclosure walls. Each clip can include at least one outwardly extending leg relative to the walls. A retainer cap can be secured against the forward surface of the lens for retaining the lens adjacent the enclosure and the walls. The retainer cap can comprise an extrusion readily formable into a variety of shapes. The retainer cap can include an interior face having a first edge and an opposing second edge. The first edge having an overhang engaged to the forward surface of the lens. The second edge can have a channel, wherein the channel is adapted to securely engage a plurality of the legs along an outer surface of the enclosure walls.

A channel sign assembly comprising an enclosure having at least two opposing walls. The at least two opposing walls defining the shape of the sign assembly and having an open front. The at least two opposing walls having an inner surface and a forward end. The walls can include a plurality of intermittent retention clips mounted adjacent to the forward end. Each clip can include at least one outwardly extending leg relative to the walls. The legs are aligned with and offset from the forward end. A planar lens having a forward surface, and an outer edge in the defined shape of the sign, is sized to fit within the at least two opposing walls of the enclosure. A retainer cap mounted against the forward surface of the lens is used for retaining the lens within the enclosure and against the walls. The retainer cap comprises an extrusion readily formable into a variety of shapes. The retainer cap includes an interior face having a first edge and an opposing second edge. The first edge includes an overhang engaged with the forward surface of the lens. The second edge forms a retention channel, wherein the channel is adapted to securely engage a plurality of the legs along an outer surface of the enclosure walls.

The disclosure provides for a channel sign assembly comprising an enclosure having at least two opposing walls. The at least two opposing walls define the shape of the sign assembly and include an open front. The at least two opposing walls form a forward end. The walls include a plurality of intermittent retention clips mounted adjacent to the forward end. Each clip can be mounted in a first orientation having a first outwardly extending leg relative to the walls. The legs are aligned with and offset from the forward end. A planar lens is provided having a forward surface and an outer edge in the defined shape of the sign. A retainer cap can be mounted against the forward surface of the lens for retaining the lens within the enclosure and against the walls. The retainer cap comprises an extrusion readily formable into a variety of shapes. The retainer cap includes an interior face having a first edge and an opposing second edge. The first edge includes an overhang engaged with the forward surface of the lens. The second edge forms a retention channel, wherein the channel is adapted to securely engage a plurality of the legs along an outer surface of the enclosure walls.

The disclosure further provides for a channel sign assembly comprising an enclosure having at least two opposing walls. The at least two opposing walls define the shape of the sign assembly and include an open front. The at least two opposing walls form a forward end. The walls include a plurality of intermittent retention clips mounted adjacent to the forward end. Each clip can include a unitary structure comprising a top edge, a planar body, and an outwardly extending leg relative to the body. The plurality of clips and associated legs are aligned with and offset from the forward end. The sign assembly further includes a planar lens having a forward surface and an outer edge in the defined shape of the sign. A retainer cap can be mounted against the forward surface of the lens for retaining the lens within the enclosure and against the walls. The clips further comprise double faced adhesive tape including a first face of the tape secured to a mounting side of the body of the clip; a second face of the tape secured to an outer surface of the walls; and, the top edge of the clip including a first portion generally at about 90 degrees to the body for resting on the forward end and stopping the clip at the proper mounting position.

DETAILED DESCRIPTION

Figure 1:
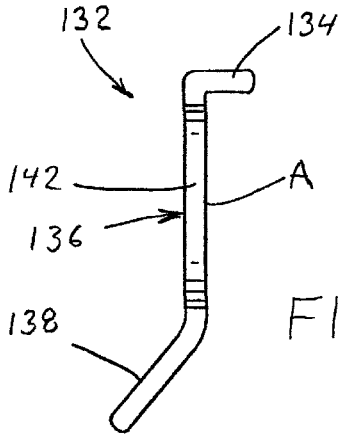
FIG. 1 is an edge view of a retainer clip according to a first embodiment.
Figure 2:
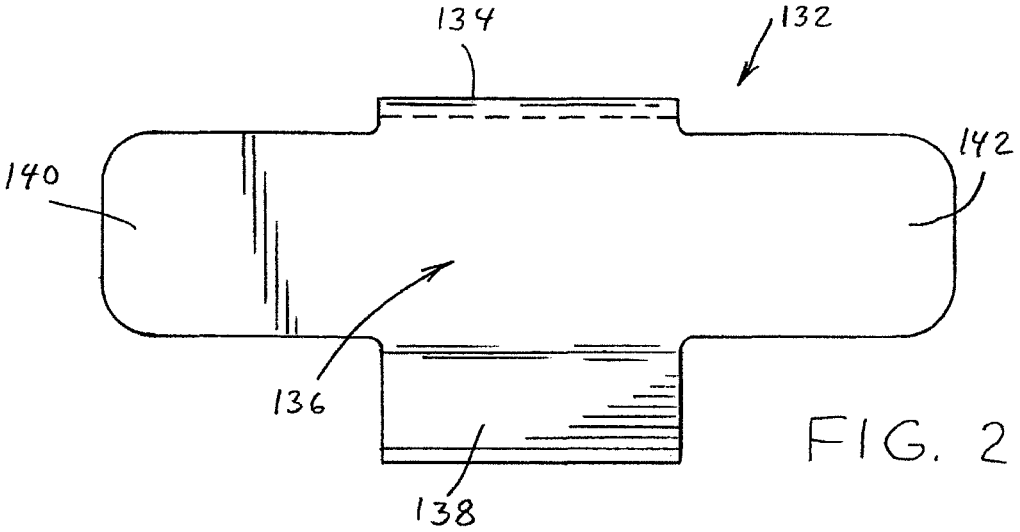
FIG. 2 is a front view of the retainer clip of FIG. 1.
Figure 3:
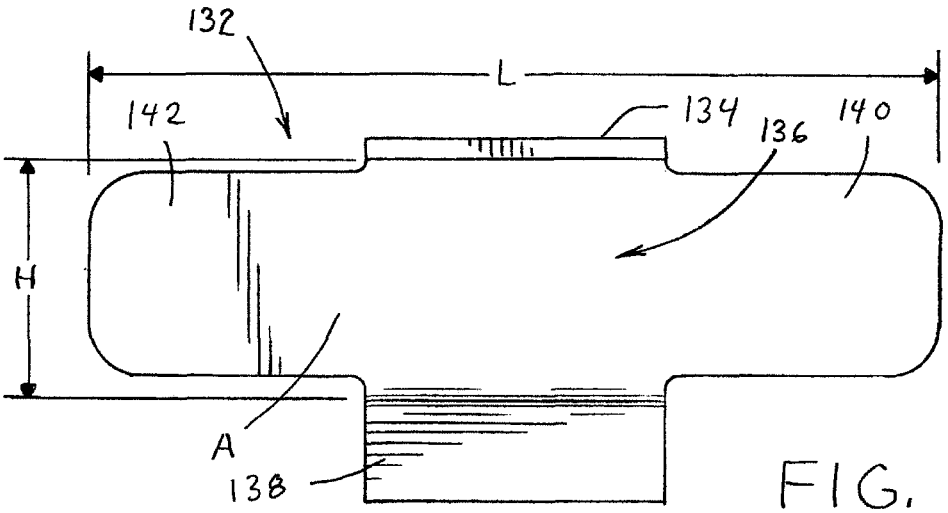
FIG. 3 is a rear view of the retainer clip of FIG. 1.

Referring to FIGS. 1-4, and in accordance with the present disclosure, a channel letter assembly 10 having a retaining clip 132 is therein displayed. The clip 132 provides a means for securing a trim cap or retainer cap 34 to the walls 38 of an enclosure 44. To facilitate retention of a lens 42 against the front edge 58 of the walls 38 of the enclosure 44, a plurality of the retainer clips 132 can be spaced along the front edges or terminal ends 58 of the walls 38 of the enclosure 44. Each of the retainer clips 132 can comprise a unitary structure comprising a top edge 134, a planar body 136, and an outwardly extending leg 138 relative to the body 136. The clip 132 can be made from plastic (i.e. extruded). The extruded (or metal formed) clips can be cut, bent, and/or punched to a variety of shapes including the exemplary clip shape 132. It is to be appreciated that any number of similarly shaped and/or similarly dimensioned clips can be extruded, cut, and/or formed to meet the objectives described herein. The clip 132 comprises a left arm 140 and a right arm 142 extending in a co-planar arrangement from the body 136. The distance L between the terminal ends of the left arm 140 and the right arm 142 can be greater than twice the height H of the body 136. It is to be appreciated that the greater length L, relative to the height H, provides an increased surface area A for supporting the clip 132 to the walls 38 of the enclosure. The increased surface area A also provides for an increased adhesive area for securing the clip 132 to the walls 38 of the enclosure. A double faced adhesive tape can be applied to area A to further secure clip 132 to the walls 38 of the enclosure. In one exemplary embodiment the clip 132 is made from a rigid PVC material. A plurality of such retainer clips 132 can be positioned around the outer edge of the walls 38 thereby providing an attachment means for the trim cap 34 and lens 42 to the walls 38 of the enclosure 44. Retaining the trim cap 34 to the walls 38 of the enclosure in turn provides the means for securing the lens 42 to the enclosure walls 38 thereby providing a water resistant cover to the interior of the enclosure 44.

It is to be appreciated that the channel enclosure can be made from non-metal materials (i.e. rigid or semi-rigid plastics). Non-metal materials can be used in conjunction with clips 132 discussed herein.

Figure 4:
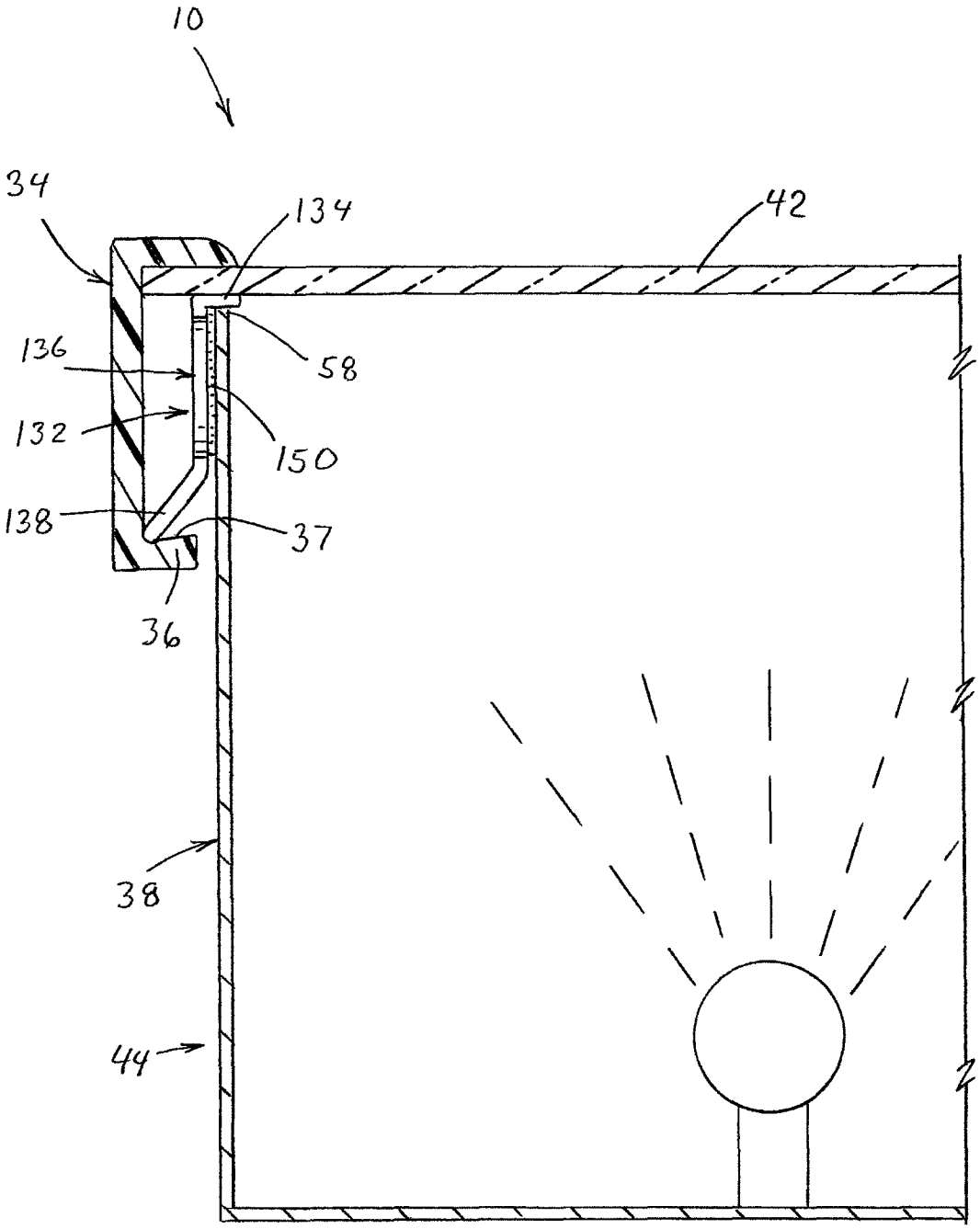
FIG. 4 is a cross sectional view of the channel letter assembly employing the retainer clip of FIG. 1 in accordance with the present invention.
Figure 8:
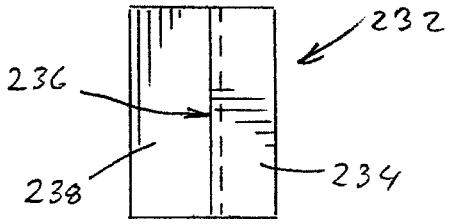
FIG. 8 is a top view of the retainer clip of FIG. 7.
Figure 5:
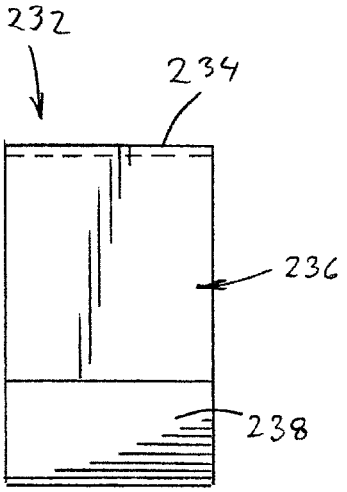
FIG. 5 is a front view of a retention or retainer clip according to a second embodiment.
Figure 6:
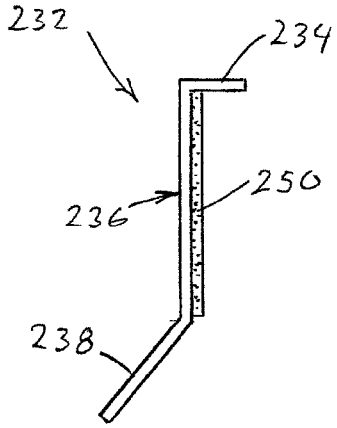
FIG. 6 is an edge view of the retainer clip of FIG. 5.
Figure 7:
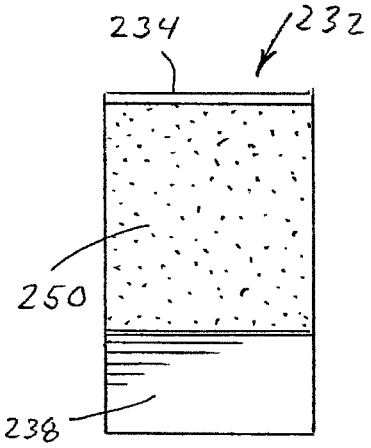
FIG. 7 is a rear view of the retainer clip according to the second embodiment.

Referring to FIG. 4, the channel sign assembly 10 in accordance with the present disclosure is therein displayed. The assembly can include a metal enclosure 44 having a plurality of sheet metal side walls 38. The retainer cap, snap cap, or trim cap 34 can be attached, i.e. firmly glued to the lens 42. The lens 42 and retainer cap 34 provide lateral support to the walls 38. The lens 42 and the retainer cap 34 prevent the walls 38 from moving towards each other and from bowing outward away from each other.

Referring to FIG. 4, the retainer clip 132 can be fitted on the forward end 58 of a wall 38 with the leg 138 extending outward away from the wall 38. The retaining clip 132 can be easily installed with a double faced adhesive tape 150, or cyanoacrylate glue, or similar, secured to the inside of the body 136. When all the retainer clips 132 have been installed along the walls 38 of the enclosure 44, the lens 42 can be positioned to rest on the outer surface of the top edge 134 of the clips 132. Referring to the figures, it is to be appreciated that after a retainer clip 132 has been installed, the top edge 134 will 'rest' against the front edge 58 of the wall 38 and, along with the double faced adhesive tape 150, will resist removal of the retainer clip 132 (i.e provide retaining anchor for trim cap 34).

In accordance with the present invention, to retain the lens 42 against the terminal ends of the shoulder, a plurality of retainer clips 132 are spaced and mounted along the outer end of the walls of the enclosure. Each of the retainer clips 132 can comprise a unitary generally rigid body 136 having a first interior side and a second exterior side. The top edge 134, body 136, leg 138, and arms 140, 142 of the clip 132 can be made from rigid metal (i.e. stainless steel) or plastic (i.e. rigid PVC). The top edge 134 can be at a generally 90 degree angle relative to the body 136. The top edge 134 resting on the front edge 58 of the wall 38, coupled with the double faced adhesive 150 secured between the body 136, arms 140, 142, and wall 38, resists removal of the clip 132. A plurality of such retainer clips 132 can be positioned around the front edge of the walls thereby providing an attachment means for the trim cap 34 to the walls 38 of the enclosure 44. Retaining the trim cap 34 (in place) in turn provides the means for securing the lens 42 to the enclosure walls.

The clips 132, once installed, provide a tab or leg 138 that extends outward away from the walls 38 of the channel and can engage a foot 36 of the retainer cap 34 (i.e. in a 'snap cap' or friction engagement arrangement). The foot 36 can extend in a length from about ¼ inch to about 1¼ inches. The foot 36 of the retainer cap 34 can be in the form of a receiver or retention channel having a face 37 angled upward from about 3 degrees to about 9 degrees from horizontal. In one arrangement, the receiver can be angled upward from about 5 degrees to about 7 degrees from horizontal.

The clips 132 can be placed onto the channel walls 38 at random positions around the letter or shape at the discretion of an installer. The number and intermittent spacing of the clips 132 will be dependent upon the size and design of the channel sign. The interlocking effect of the foot 36 of the retainer cap 34 to the tabs 138 will enable secure attachment of the plastic lens 42 and retainer cap 34 to the metallic channel 38.

The tabs 138 of the clips 132 can be positioned such that they are aligned with and proximal to the front edge 58 of the side walls 38. The adhesive 150 securing the clips 132 to the wall 38 enables a positive engagement of the inside faces of the clips 132 to the forward edge and forward side portions of the metallic channel 38.

Figure 10:
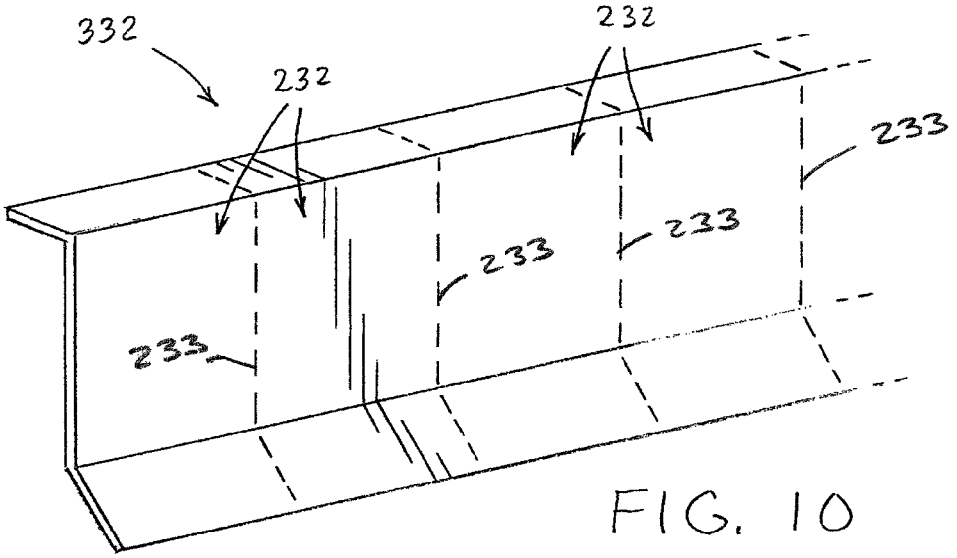
FIG. 10 represents a continuous extrusion of retaining clip material prior to cutting or punching into individual clips; and, FIG. 11 provides a view of a plurality of clips mounted to a channel letter wall.

According to another method, each individual retainer clip 232 can be cut along lines 233 from a continuous extrusion 332 (FIG. 10). The clips 232 can comprise a unitary rigid body 236 having a first leg 238, and an angled top side 234 (FIGS. 5-8). A plurality of such retainer clips 232 can be cut along lines 233 from extrusion 332 and positioned around the outer edge of the walls 38 thereby providing an attachment means for the trim cap and lens to the walls 38 of the enclosure. Retaining the trim cap to the walls 38 of the enclosure in turn provides the means for securing the lens to the enclosure walls 38 thereby providing a water resistant cover to the interior of the enclosure. The retainer clip 232 is fitted on the forward end of a wall 38 with the leg 238 extending outward away from the wall 38. It is to be appreciated that when all the retainer clips 232 have been installed along the walls 38 of the enclosure the lens 42 can be positioned to rest on the outer surface of the clips (partially illustrated in FIG. 9).

Figure 9:
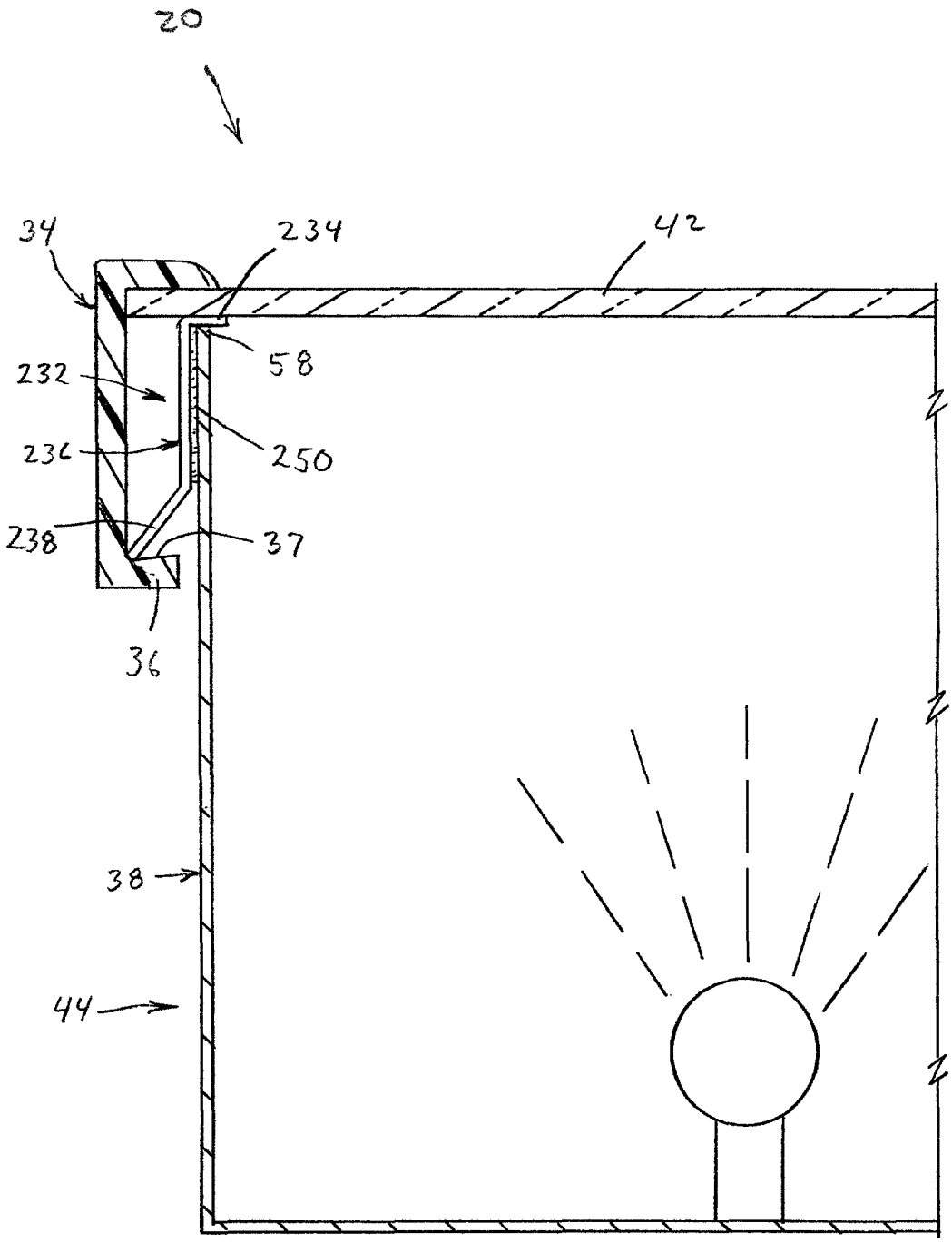
FIG. 9 is a cross sectional view of the channel letter assembly employing the retainer clip of FIG. 5.

The clips 232, once installed, provide a tab or leg 238 that extends outward away from the walls 38 of the channel and can engage a foot of the retainer cap (FIG. 9). The clips 232 can be placed onto the channel walls 38 at random positions around the letter or shape at the discretion of an installer to form a channel letter assembly 20. The number and intermittent spacing of the clips 232 will be dependent upon the size and design of the channel sign. The interlocking effect of the foot 36 of the retainer cap 34 to the tabs 238 will enable secure attachment of the plastic lens 42 and retainer cap 34 to the metallic channel. The tabs 238 of the clips 232 can be positioned such that they are aligned with and proximal to the front edge of the side walls.

It should also be appreciated that the retainer clips 132, 232 may be manufactured and/or cut in more than one size and/or shape to provide desirable fitting between the sides and clips in order to accommodate a variety of wall thicknesses (and materials), and a variety of installation means. To further secure the clips 132, 232 to the enclosure walls 38, an adhesive or double-faced tape 150, 250 can be used to secure the clips 132, 232 along the walls 38. It is to be appreciated that the channel enclosure can be made from non-metal materials (i.e. rigid or semi-rigid plastics). Non-metal materials can be used in conjunction with retainer clips and trim cap discussed herein.

As described herein and illustrated in FIGS. 4 and 9, the retainer clips 132, 232 can be fitted on the forward end of a wall 38 with the leg 138, 238 extending outward away from the wall. The retaining clips can be easily installed, in one arrangement, with an adhesive glue or epoxy (i.e. cyanoacrylate) secured to the inside of the body 136, 236. When all of the retainer clips 132, 232 have been installed along the walls of the enclosure, the lens 42 can be positioned to rest on the outer surface of the top edge 134, 234 of the clips. It is to be appreciated that after a retainer clip 132, 232 has been installed, the top edge 134, 234 will 'rest' against the front edge of the wall and along with the adhesive epoxy, or double faced tape, will resist removal of the retainer clip 132, 232.

Figure 11:
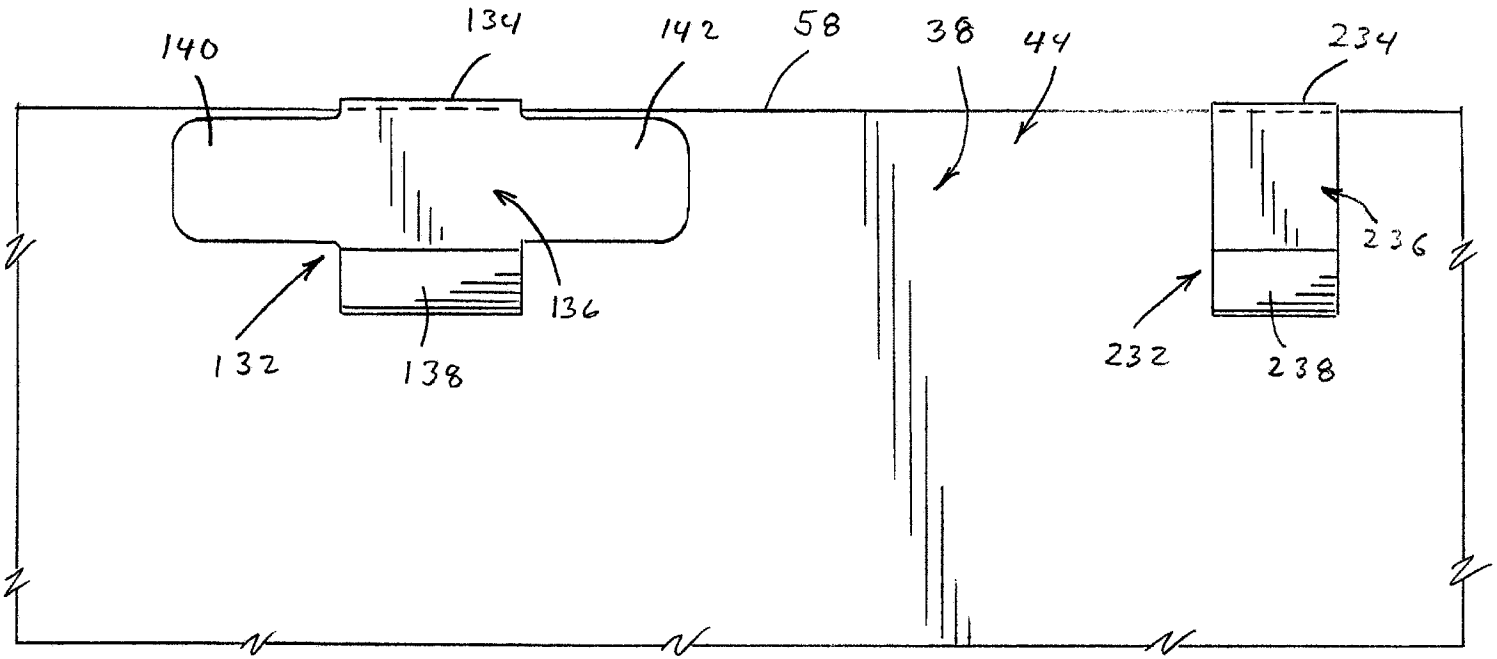

In accordance with the present invention, to retain the lens against the walls of the letter sign, a plurality of retainer clips 132, 232 are spaced along the outer end of the walls of the enclosure (FIGS. 4, 9, and 11). Each of the retainer clips 132, 232 can comprise a unitary generally rigid body having a first interior side and a second exterior side. The top edge, body, and leg of the clip 232 can be cut from a cured rigid plastic extrusion 332. Also, the top edge can be at a generally 90 degree angle relative to the body. The top edge resting on the front edge of the wall, coupled with the adhesive epoxy or, in another arrangement, double-faced adhesive tape secured between the body and wall, resists removal of the clip. A plurality of such retainer clips 132, 232 can be positioned around the front edge of the walls thereby providing an attachment means for the trim cap 34 to the walls of the enclosure. Retaining the trim cap 34 (in place) in turn provides the means for securing the lens 42 to the enclosure walls.

The adhesive epoxy securing the clips to the wall enables a positive engagement of the inside faces of the clips to the forward edge and forward side portions of the metallic channel. In another embodiment, the individual clips can be cut or punched from the extrusion to include extended 'arms' to provide increased surface area for mounting the clips to the wall.

It is to be appreciated that the different dimensioned lenses can include thicknesses of ⅛ inch and 3/16 inch. When a channel sign assembly is assembled using the clips 132, 232 as described, the finished product will present a more attractive appearance than one assembled using screws. In addition, when it is time to service the sign assembly to replace LEDs, or other devices, the trim or retainer cap can be pried off, which will allow the service technician to free the entire perimeter, or a desired portion thereof, of the retainer cap from the forward end of the channel sign enclosure without the use of a screwdriver and the cumbersome removal of screws.

The exemplary embodiments have been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A channel sign assembly comprising:

an enclosure having at least two opposing walls, said at least two opposing walls defining the shape of said sign assembly and having an open front;

said at least two opposing walls having an inner surface and a forward end;

said walls including a plurality of intermittent retention clips mounted adjacent to said forward end;

each said clip includes a unitary structure comprising a top edge, a planar body, and an outwardly extending leg relative to said body;

each said clip includes a first arm and a second arm extending from said planar body wherein said first arm and said second arm are coplanar with said body;

said legs are aligned with and offset from said forward end when each said clip is in a mounted position;

a planar lens having a forward surface, and an outer edge in said defined shape of said sign and positiond adjacent said at least two opposing walls of said enclosure;

a retainer cap against said forward surface of said lens for retaining said lens within said enclosure and against said walls;

said retainer cap comprises an extrusion readily formable into a variety of shapes;

said retainer cap includes an interior face having a first edge and an opposing second edge;

said first edge having an overhang engaged with said forward surface of said lens; and, said second edge forming a retention channel, wherein said channel adapted to securely engage a plurality of said legs along an outer surface of said enclosure walls.

2. The channel sign assembly in accordance with claim 1, wherein each said clip further comprises:

double faced adhesive tape including a first face of said tape secured to a mounting side of said body and said arms of said clip; and, a second face of said tape secured to an outer surface of said walls.

3. The channel sign assembly in accordance with claim 2, wherein said top edge generally at about 90 degrees to said body for resting on said forward end and stopping said clip at the proper mounting position.

4. A channel sign assembly comprising:

an enclosure having at least two opposing walls, said at least two opposing walls defining the shape of said sign assembly and having an open front;

said at least two opposing walls forming a forward end;

said walls including a plurality of intermittent retention clips mounted adjacent to said forward end;

each said clip includes a unitary structure comprising a top edge, a planar body, and an outwardly extending leg relative to said body;

each said clip includes a first arm and a second arm extending from said planar body wherein said first arm and said second arm are coplanar with said body;

said legs are aligned with and offset from said forward end;

a planar lens having a forward surface and an outer edge in said defined shape of said sign; and, a retainer cap mounted against said forward surface of said lens for retaining said lens within said enclosure and against said walls.

5. The channel sign assembly in accordance with claim 4, wherein said retainer cap comprises an extrusion readily formable into a variety of shapes;

said retainer cap includes an interior face having a first edge and an opposing second edge;

said first edge having an overhang engaged with said forward surface of said lens; and, said second edge forming a retention channel, wherein said channel adapted to securely engage a plurality of said legs along an outer surface of said enclosure walls.

6. The channel sign assembly in accordance with claim 5, wherein said channel of said second edge includes a receiver adapted to receive said plurality of said legs, wherein said receiver is positioned at an angle from about 3 degrees to about 9 degrees from a horizontal plane wherein said horizontal plane is substantially perpendicular to said enclosure walls.

7. The channel sign assembly in accordance with claim 6, wherein said receiver includes partially flexible material extending inwardly from said interior face of said retainer cap, wherein said legs wedge between said retention channel and said exterior face of said enclosure walls when said retainer cap is fitted against said enclosure walls.

8. A channel sign assembly in accordance with claim 4, wherein each said clip comprises double faced adhesive tape including a first face of said tape secured to a mounting side of said body and said arms of said clip;

a second face of said tape secured to an outer surface of said walls; and, said top edge including a first portion generally at about 90 degrees to said body for resting on said forward end and stopping said clip at the proper mounting position.

9. The channel sign assembly in accordance with claim 4, wherein each said clip comprises adhesive glue affixed between a mounting side of said body and each said clip, for mounting each said clip to said walls.

10. A channel sign assembly comprising:

an enclosure having at least two opposing walls;

said at least two opposing walls having an inner surface and a forward end;

a plurality of selectively positioned and oriented retention clips adjacent said forward end;

each said clip includes a unitary structure comprising a top edge, a planar body, and an outwardly extending leg relative to said body; and, each said clip cut to size from a continuous extruded cured rigid plastic, wherein each said clip includes a first arm and a sexond arm extending from said planar body wherein said first arm and said second arm are coplanar with said body.

11. The channel sign assembly in accordance with claim 10, wherein each said clip comprises double faced adhesive tape including a first face of said tape secured to a mounting side of said body and said arms of said clip;

a second face of said tape secured to an outer surface of said walls; and, said top edge including a first portion generally at about 90 degrees to said body for resting on said forward end and stopping said clip at the proper mounting position.

12. The channel sign assembly in accordance with claim 10, wherein each said clip comprises adhesive glue affixed between a mounting side of said body and each said clip, for mounting each said clip to said walls.

13. A plurality of plastic clips for retaining a trim cap and a lens adjacent an enclosure having at least two opposing walls, each said clip comprising:

a unitary rigid structure having a top edge, a planar body, and an outwardly extending leg relative to said body; and, each said clip cut to size from a continuous cured rigid plastic extrusion;

wherein each said clip includes a first arm and a second arm extending from said planar body wherein said first arm and said second arm are coplanar with said body.

14. The plastic clip of claim 13, wherein each said clip comprises double faced adhesive tape including a first face of said tape secured to a mounting side of said body and said arms of said clip;

a second face of said tape secured to an outer surface of said walls; and, said top edge including a first portion generally at about 90 degrees to said body for resting on said forward end and stopping said clip at the proper mounting position.

15. The plastic clip of claim 13, wherein each said clip comprises adhesive glue affixed between a mounting side of said body and each said clip, for mounting each said clip to said walls.

16. The plastic clip of claim 13, wherein each said clip comprises double faced adhesive tape including a first face of said tape secured to a mounting side of said body and said arms of said clip;

a second face of said tape secured to an outer surface of said walls; and, said top edge including a first portion generally at about 90 degrees to said body for resting on said forward end and stopping said clip at the proper mounting position.

17. The plastic clip of claim 13, wherein each said clip comprises adhesive glue affixed between a mounting side of said body and each said clip, for mounting each said clip to said walls.

* * * * *